United States Patent [19]

Kelly et al.

[11] Patent Number: 4,926,186

[45] Date of Patent: May 15, 1990

[54] FFT-BASED APERTURE MONITOR FOR SCANNING PHASED ARRAYS

[75] Inventors: Robert J. Kelly, Ruxton; Edward F. C. LaBerge, Towson, both of Md.

[73] Assignee: Allied-Signal Inc., Morris Township, Morris County, N.J.

[21] Appl. No.: 326,133

[22] Filed: Mar. 20, 1989

[51] Int. Cl.[5] ..... H01Q 3/00

[52] U.S. Cl. ..... 342/360; 342/173

[58] Field of Search ..... 342/372, 360, 173, 174

[56] References Cited

U.S. PATENT DOCUMENTS 4,488,155 12/1984 Wu ..... 342/376

*Primary Examiner*—Theodore M. Blum

*Attorney, Agent, or Firm*—Howard G. Massung

[57] ABSTRACT

Method and means for monitoring the performance of a phase array antenna. The antenna comprises an array of individual radiating element seach of which radiates a prescribed proportion of the energy to be transmitted thereby shaping such energy into a beam. Individual phase shifters are associated with each radiating element, the phases of which control the direction of the beam pointing. The method of the invention involves sampling the beam by means including a single receiver located along a fixed radial from the array. The beam scans at a constant rate. The samples are collected at non-uniform intervals of time during a beam scan. The samples are, however, separated by equal increments of arcsine $\theta$, where $\theta$ is the pointing angle of the beam. The samples are analyzed by means including a Fourier transform to provide the value of the amplitude and phase of the signal radiated by each of the radiating elements. Comparison of the amplitude and phase values for each radiating element as determined by analysis with design values for each element reveals any element or phase shifter which may be faulty. The method can also be used to calibrate an antenna when it is first put into service.

18 Claims, 6 Drawing Sheets

FFT-BASED APERTURE MONITOR FOR SCANNING PHASED ARRAYS

BACKGROUND OF THE INVENTION

1. Field of the Invention

The present invention relates to phased array antennas. More particularly it relates to a system and method for monitoring the signal radiated by a phased array antenna which provides an indication of faults in components of the antenna and identification of the faulty components. The invention also provides an accurate and convenient method for calibrating a phased array antenna for initial use.

Phased array antennas are found in a variety of applications primarily because of their ability to produce a radiation pattern of specified characteristics which may be steered electronically to any desired angle within certain coverage limits. The phased array antenna application of particular interest herein is in the Scanning Beam Microwave Landing System, but it is to be understood that the invention may be used in conjunction with phased array antennas in other applications.

2. Description of the Prior Art

A linear phased array antenna used in a Scanning Beam Microwave Landing System is described in U.S. Pat. No. 3,999,182 issued Dec. 21, 1976 to A. W. Moeller et al. In this antenna a plurality of radiating elements are spaced equally along a linear axis. The elements of the array lying to the left and to the right of the center element are each fed r.f. energy through individual electronically variable phase shifters, each of which is coupled into right and left branching series feed lines through individual directional couplers. The center elements of the array and the right and left branch series feed lines are coupled to a common microwave source through a four-way directional coupler.

The number of radiating elements and associated phase shifters and couplers present in an array is dependent upon such design factors as the desired beam width and sidelobe levels of the radiation pattern of the array and the scan angle coverage of the array. The elevation antenna described in the referenced patent includes eighty-one directional couplers and provides a radiation pattern of 1° beam width with a maximum sidelobe level of −27 dB. The scan angle coverage is from 0° to +20° in elevation.

Specific radiation pattern characteristics of the array require that each element coupler be designed to supply a precisely determined portion of power from the feed to the associated element and that each element be coupled into the feed with a particular insertion phase. The numerous components involved in a phased array antenna increase the number of sources of possible failure in the system. In compensation, however, a failure occurring in any one component does not result in total failure of the system but only results in a marginal degradation in beam quality. As the number of failed components increases, the beam quality decreases correspondingly until the deterioration exceeds a tolerable level and the system can no longer be safely used.

Monitoring systems have heretofore been used in conjunction with phased array antennas in the Microwave Landing Systems to warn of impending or actual system failure or to identify specific component failures, such as a diode failure in a digital phase shifter. One such monitor system comprises a receiver located at some distance from the antenna along a particular radial or elevation angle. The equivalent of a receiver located at a fixed point in the far field of the antenna is provided by an integral monitor usually comprising a slotted waveguide extending the length of the antenna array in close proximity thereto. Energy from the antenna array is coupled into the waveguide through the slots with the proper phases to produce a signal at the waveguide output corresponding to the signal which would be received at a distant point along a fixed radial from the array. The detected signal from the distant receiver or integral monitor provides data from which the beam main lobe and sidelobe signal strengths and pointing angles can be measured. Comparison of measured values of these quantities with stored values of similar quantities obtained during calibration of the array can reveal departure of the system performance below an acceptable level. Such a monitor is suitable for on-line executive use to alert operating personnel to the need to remove the system from service for maintenance. Such a monitor does not identify the system component or components at fault. Further measures must be taken to isolate and correct or compensate for the malfunction. These additional measures are taken while the array is out of service and involve determining the amplitude and phase of the monitor signal for each element of the array, element by element.

One disadvantage of such prior methods of fault identification and fault compensation of a phased array is the necessity to provide a highly efficient r.f. switch for each element of the array. Another disadvantage is that the test procedures cannot be conducted while the array is operating in service.

The present invention is in a method of processing data from a distant monitor receiver or from an integral monitor antenna which is capable of detecting and identifying non-time varying amplitude and phase faults as to each element of a phased array antenna during on-line operation of the array.

It is an object of the invention to provide a monitoring system for a phased array antenna capable of identifying special faults in the antenna during operation of the antenna in service.

It is another object of the invention to provide a monitoring system for a phased array antenna capable of determining phase insertion errors for each radiating element of the array.

Still another object of the invention is to provide a monitoring system for a phased array antenna capable of identifying particular elements of the array having faults in their associated r.f. feedlines, couplers or connectors.

It is a further object of the invention to provide a monitoring system for a phased array antenna capable of automatically calibrating the array to provide specific phase correction factors to compensate for phase shifter errors resulting from manufacturing tolerances.

Briefly, the invention comprises a method of sampling and processing data collected by a single monitor receiver located in the far field of a scanning phased array antenna, or by an equivalent integral monitor, which enables the antenna illumination function to be received. The beam transmitted by the antenna scans at constant rate between maximum scan angles of $+\theta_0$, $-\theta_0$, $\theta$ being the angle between the axis of the beam and the normal to the axis of the array. The output of the monitor receiver is sampled at non-uniform intervals of time. The sampling interval does, however, correspond to equal intervals of the arcsine of the scan angle $\theta$.

The data collected by the monitor receiver is processed by a Fast Fourier Transform (FFT) to provide a recovered illumination function. The recovered illumination function shows the relative amplitude and phase of the energy distributed across the array aperture which created the received signal. Comparison of the recovered illumination function at each sampling point with design values of the illumination function for each element of the array reveals any specific array element at which the amplitude or phase has departed from allowable tolerance.

An amplitude fault usually requires removal of the array from service for repair of the r.f. transmission line, connectors or couplers associated with the faulty array element. Phase faults may be of such nature that correction can be accomplished by simply adding a compensating factor to the phase increment generated for the faulty element by the system beam steering unit. Since the invention identifies the particular element or elements of the array responsible for any degraded performance of the array, the down-time required for repair of the system is much less than in a system having a monitor which warns only of unacceptable performance.

The invention is based upon the accepted theory that the radiation pattern of an antenna can be synthesized from a known aperture illumination function by computing the Fourier transform of the illumination function.

A plurality of receivers placed with equal spacing along a line of length subtending an angle $\theta = \text{arc}\sin(\lambda/d)$, where d is the interelement spacing of the array, would provide n individual signals which may be vectorially summed to provide the Discrete Fourier Transform (DFT) of the illumination function. Then the Inverse Fourier Transform (IFT) of the DFT provides the reconstructed array illumination function.

By sampling the output of a single monitor receiver at non-uniform intervals the invention provides data equivalent that which would be provided by the above described plurality of receivers. Specifically, the time at which the monitor receiver output is sampled is determined by the relationship:

$$t_k = \frac{\sin^{-1}\left[\frac{\lambda}{2d}\left(1 - \frac{2k}{N}\right)\right]}{\theta_s} - t_o;\ k = 0,1 \ldots N-1 \tag{1}$$

where $t_k$ is the time interval between commencement of the antenna beam scan and the Kth sample;

$\lambda$ is the wavelength of the radiated energy;

d is the spacing between radiating elements of the array;

N is the number of radiating elements of the array;

$t_o$=scan start time; and $\theta_s$ is the beam scan rate in radians/sec.

The samples thus taken by the single receiver are stored in memory in proper order to facilitate processing by a Fast Fourier Transform (FFT) algorithm, the result of which is the reconstructed aperture function of the array. Comparison of the coefficients of the reconstructed aperture function with design values for the corresponding coefficients of the aperture function enables individual identification of radiating elements which are defective in amplitude or phase.

DETAILED DESCRIPTION OF THE PREFERRED EMBODIMENTS

Figure 1:
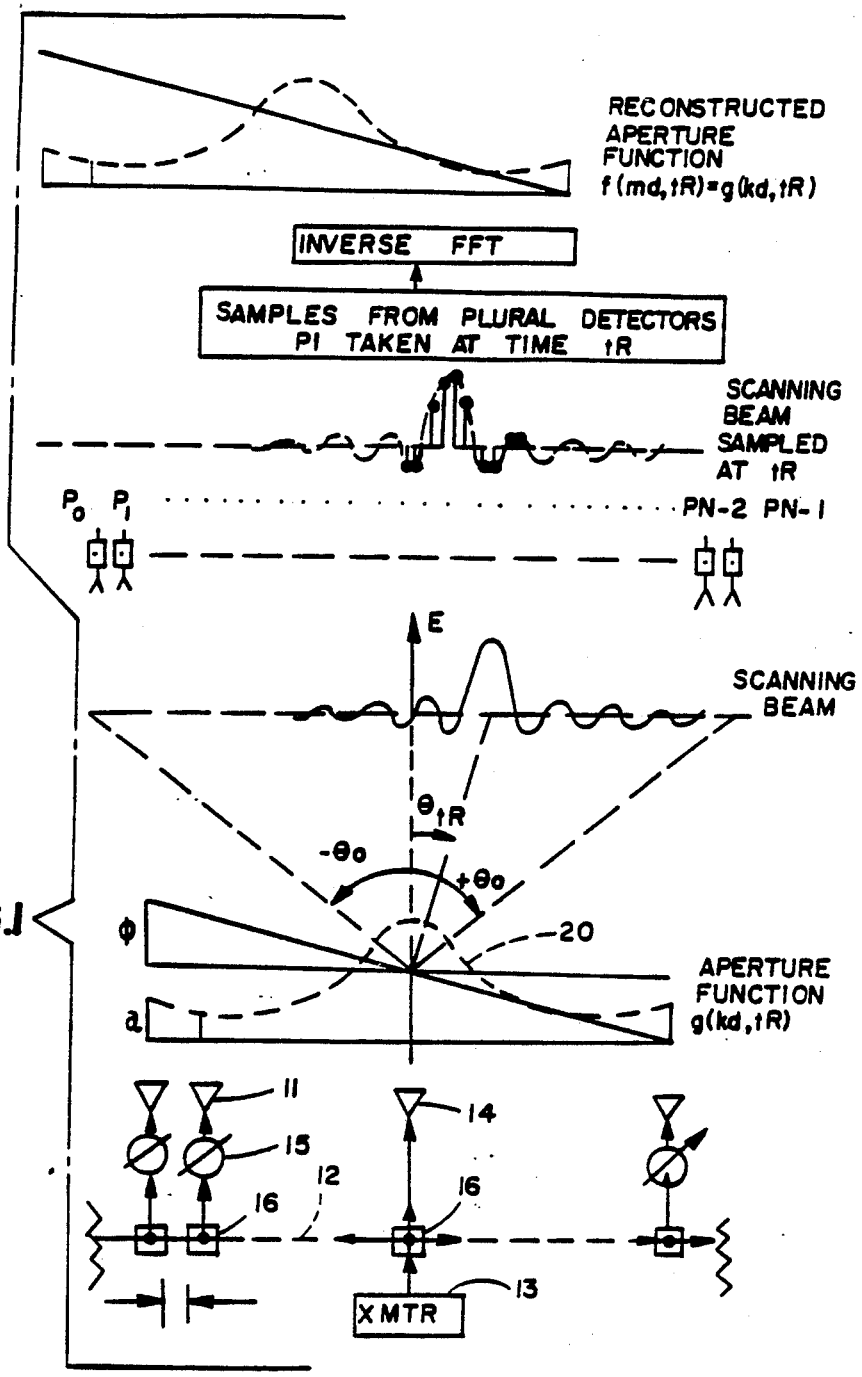
FIG. 1 is a diagram illustrating a linear phased array antenna, the beam produced thereby as represented by the aperture function g(kd, $t_R$), the beam as sampled at time $T_r$ by a plurality of detectors and the beam aperture function as reconstructed by processing the samples from the plural detectors with an inverse Fourier transform.

FIG. 1 illustrates the theory of the invention. A phased array antenna 10 is represented schematically as comprising N linearly disposed radiating elements 11 evenly spaced at intervals d along a corporate feed 12 which is supplied with microwave energy by a transmitter 13. Each of the elements 11, except center element 14 if N is an odd number, is connected to feed 12 through a variable phase shifter 15 and a coupler 16 which conducts a proportion $a^2_n$ of the transmitter output power to the element. Center element 14 is connected to feed 12 only through a coupler 16' if N is an odd number. Antenna beam steering is accomplished by electronically adjusting each of the phase shifters to apply a specified phase shift $\theta k$ to the energy passing therethrough to its associated radiating element. The phase shifts vary along the length of the array, beginning at the left end element k=1 and ending at the right end element k=N, according to the relationship:

$$\phi_k = \frac{2\pi d}{\lambda}\left(k - \frac{N+1}{2}\right)\sin\theta_o - \sin\theta_{tR} \tag{2}$$

where:

N is the total number of array elements;

k=1, 2 . . . N, is the index number of the individual array elements;

$\theta_0$ is the maximum scan angle of the array beam, measured from the normal to the array; and $t_R$ is the beam pointing angle, at time ($t_R$).

The element weights, or coupling coefficient, $a_n$ are defined by the aperture amplitude distribution function which may take the form shown by the dashed line 20.

The antenna aperture function, which combines the aperture amplitude distribution function 20 and the phase function 21 is given by:

$$g(kd,t)=a(kd)\epsilon^{jp(t)kd} \tag{3}$$

where a(kD) is the amplitude at the kth element;

p(t) kd is the phase gradient at the kth element at time (t); where $$p(t) = \frac{2\pi}{\lambda} \sin\theta\ (t) \tag{3a}$$

The far field antenna pattern 22, represented by the expression G(p, t), is mathematically equivalent to the Fourier transform of the aperture function, equation (3); i.e.

$$G(p,t) = \sum_{k=0}^{N-1} g(kd,t)\epsilon^{-jpkd} \tag{4}$$

where $$p\ kd = \frac{2\pi}{\lambda}\ kd \sin\theta \tag{4a}$$

substituting (3) into (4), $$G(p,t) = \sum_{k=0}^{N-1} a(kd)\epsilon^{-j(p-p(t))kd} \tag{5}$$

Assuming, for analytical purposes, that the space extending in the far field from $+\theta_0$ to $-\theta_0$ is provided with a plurality of detectors equiangularly spaced at $p_i$. The sampled scanning beam is $$G(p_i,t) = \sum_{k=0}^{N-1} a(kd)\epsilon^{-j(pi-p(t))kd} \tag{6}$$

where $$p_i = \frac{2\pi}{\lambda} \sin\theta_i \tag{6a}$$

The inverse discrete Fourier transform of the sequence represented by equation (6), where each of the samples $p_i$ is taken at time $t_R$ is $$f(md,t_R) = \frac{1}{N}\sum_{i=0}^{N-1} G(p_i,t_R)\epsilon^{+jpimd} \tag{7}$$

Equation (7) is equivalent to the original aperture function, equation (3), for a specific scan angle at time $t_r$ as is shown by the following development:

$$\begin{aligned} f(md) &= \frac{1}{N}\sum_{L=0}^{N-1}\left[\sum_{k=0}^{N-1} a(kd)\epsilon^{-j[pi-p(tR)]kd}\right]\epsilon^{jpimd} \\ &= \sum_{k=0}^{N-1} a(kd)\epsilon^{+jp(tR)kd}\left[\frac{1}{N}\sum_{L=0}^{N-1}\epsilon^{-jpi[kd-md]}\right] \end{aligned} \tag{8}$$

Let $$\frac{1}{N}\sum_{L=0}^{N-1}\epsilon^{-jpi[kd-md]} = \delta_{km} \tag{9}$$

It can be shown that $$\delta_{km} = \begin{cases} 0, k \neq m \\ 1, k = m \end{cases} \tag{9a}$$

Substituting (9) into (8)

$$f(md,t_R) = \sum_{k=0}^{N-1} a(kd)\epsilon^{jp(tR)kd}\ \delta_{km} \tag{10}$$

Since equation (10) is non-zero only when k=m and since $t_R$ is valid for any t, equation (10) may be rewritten as $$f(kd,t)=a(kd)\epsilon^{jp(t)kd}=g(kd,t) \tag{11}$$

which is the original aperture function defined in equation (3).

The possibility of reconstructing the antenna aperture function for a particular scan angle $\theta_r$ by extracting the inverse DFT from a sequence of samples taken simultaneously from a plurality of detectors at time $t_R$ is demonstrated by the development of equations (3) through (11).

Sampling the scanning beam using a plurality of detectors positioned in the far field, as assumed in the foregoing is impractical. In accordance with the invention, the beam is sampled by the equivalent of a single detector at $p_R$ located in the far field at a fixed angle $\theta(t_R)$, as will now be shown.

Figure 2:
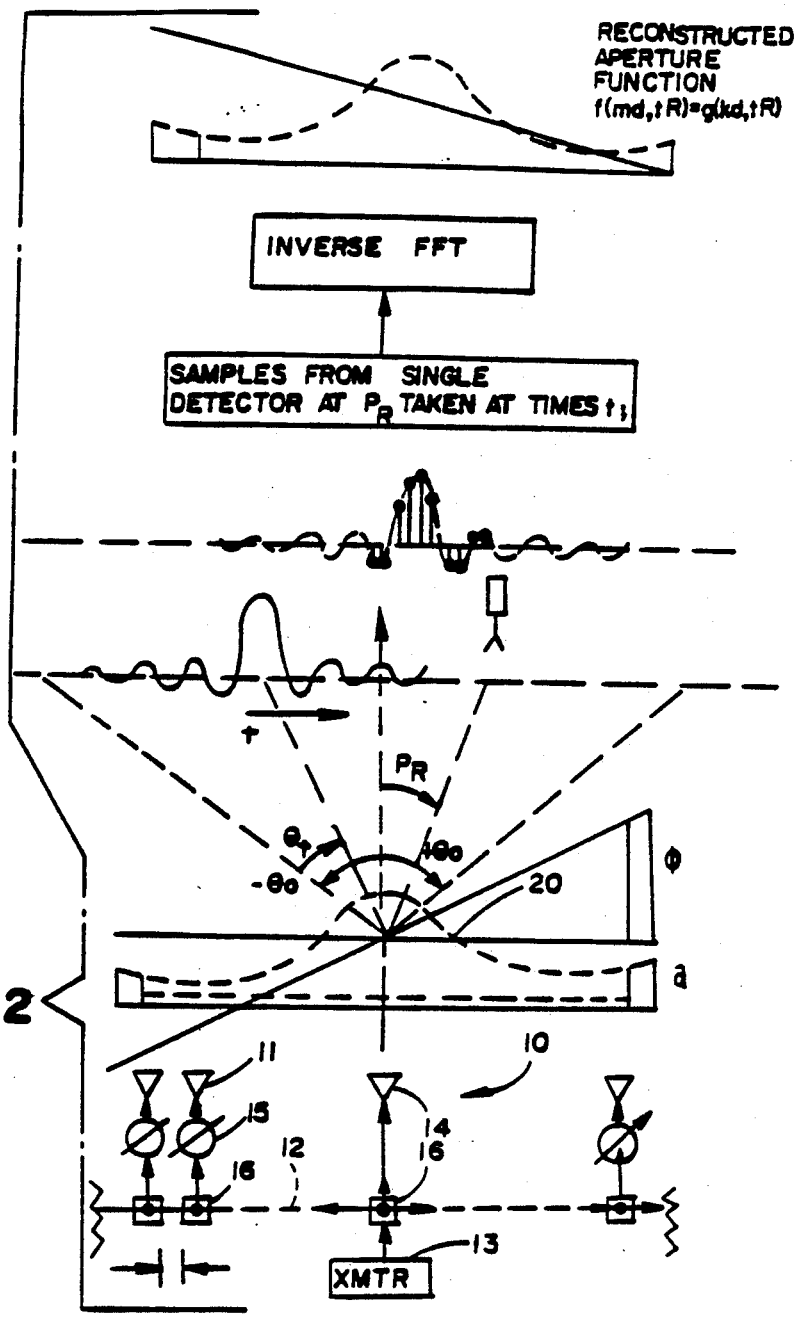
FIG. 2 is a diagram similar to FIG. 1 except that the beam is sampled at non-uniform intervals of time by a single detector located along a fixed radial angle from the center of array, in accordance with the invention.

Referring to FIG. 2, a single detector at $p_R$ is located in the far field at an angle $\theta_R$ between the maximum scan angles of $-\theta_0=\sin^{-1}(\lambda/2d)$ and $+\theta_0=\sin^{-1}(\lambda/2d)$ the detector at $p_R$ is strobed to sample the beam at times when the main lobe of the beam is pointed at equally spaced intervals of $p_i$, such that $|p_i-p_{i-1}| =\sin^{-1}(\lambda/Nd)$. The sample produced by detector $p_R$ at any sample time $t_i$ is $$G(p_R,t_i) = \sum_{k=0}^{N-1} a(kd)\ \epsilon^{-j[pi-pR]kd} \tag{12}$$

where $$p_R = \frac{2\pi}{\lambda} \sin\theta_R \tag{12a}$$

$$p_i = \frac{2\pi}{\lambda} \sin\theta_i \tag{12b}$$

$$\sin\theta_R = \text{constant} \tag{12c}$$

$$\sin\theta_i = -\frac{\lambda}{2d}\left[1-\frac{2k}{N}\right];\ i = 0, 1, 2 \ldots N-1 \tag{12d}$$

Assuming left to right beam scan at a constant rate of 20,000°/sec.=349.06 rad./sec. the scan angle $\theta_i$ at time $t_i$ after start of scan is:

$$\theta_i = -\sin^{-1}\left(\frac{\lambda}{2d}\right) + 349.06t_i \tag{13}$$

Detector $p_R$ is strobed to sample the beam at times $t_i$ given by $$t_i = \frac{\sin^{-1}\left(\frac{\lambda}{2d}\left[1 - \frac{2i}{N}\right]\right)}{349.06} - t_o \tag{14}$$

The inverse DFT of the sample sequence $G(p_R, t_i)$ taken at such times $t_i$ is given by:

$$h(md, p_R) = \sum_{L=0}^{N-1} G(p_R, t_i)\, \epsilon^{+jpi\, md} \tag{15}$$

Inserting equation (12) into equation (15)

$$h(md, p_R) = \sum_{k=0}^{N-1} a(kd)\, \epsilon^{jpR\, kd}\left[\frac{1}{N}\sum_{j=0}^{N-1} \epsilon^{-jpi\,[kd-md]}\right] \tag{16}$$

Substituting equation (9) into equation (16)

$$h(md, p_R) = \sum_{k=0}^{N-1} a(kd)\epsilon^{jpR^{kd}}\, \delta_{km} \tag{17}$$

$$\delta_{km} = \begin{cases} 0, k \neq m \\ 1, k = m \end{cases} \tag{17a}$$

Since equation (17) is equivalent to equation (10), $h(md, P_R) = f(md, t_R) = g(md, t)$ as shown by equation (11). In other words, the inverse DFT of a sequence of samples taken at times $t_i$ by a single detector $p_R$, as described with reference to FIG. 2, is identical to the inverse DFT of a sequence of samples by detectors $p_i$ taken simultaneously at time $t_R$, as described with reference to FIG. 1.

The implementation of the method of the invention will next be described with reference to FIG. 3.

Figure 3:
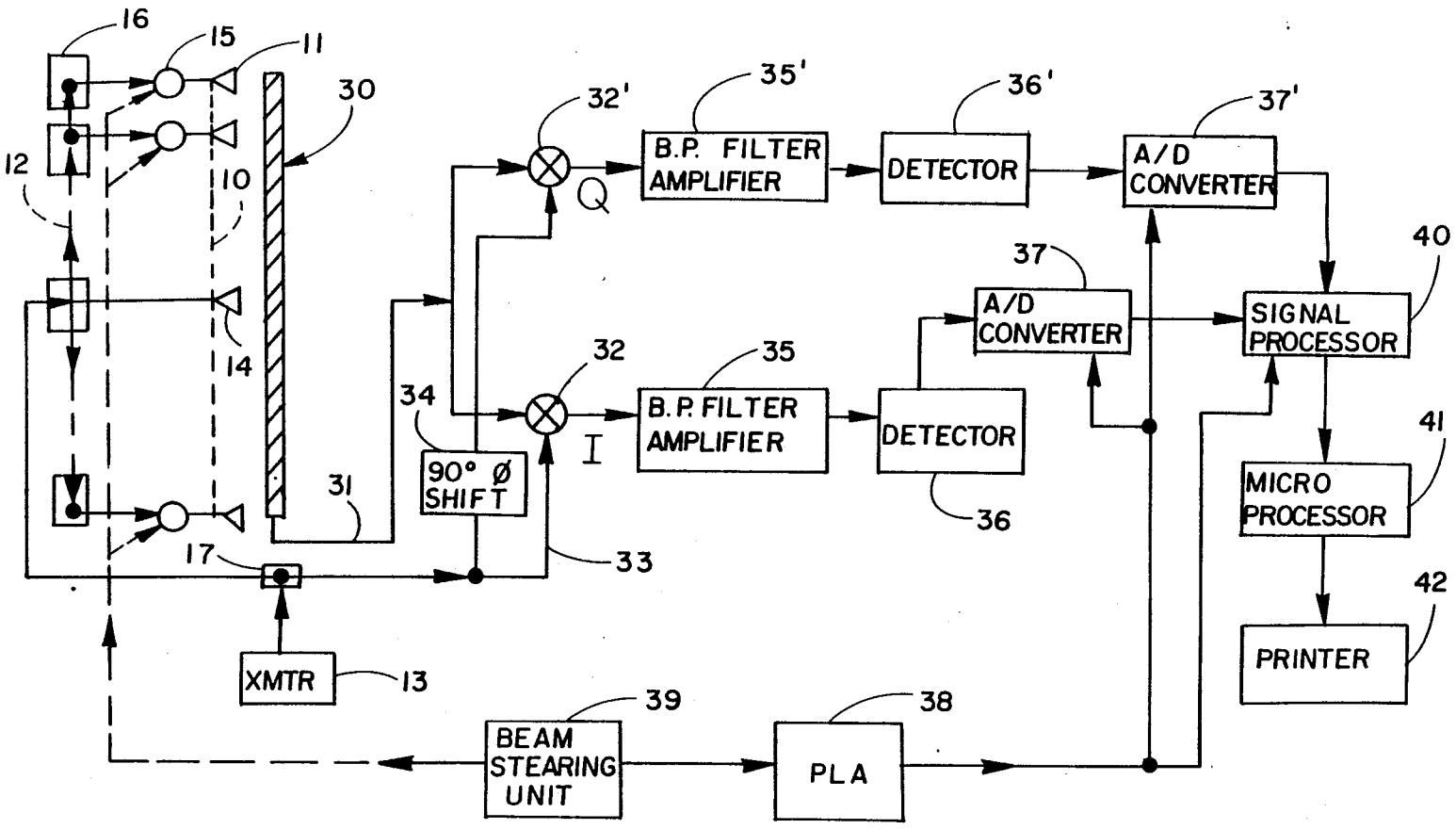
FIG. 3 is a functional block diagram of the monitor system of the invention.

FIG. 3 is a functional block diagram of the monitoring system of the invention. An N element phased array antenna 10, as described with reference to FIG. 1, is confronted by an integral waveguide monitor antenna 30. Monitor antenna 30, known in the art, comprises a slotted waveguide extending the length of the array 10 and adjacent thereto. The slots of the waveguide are so positioned and dimensioned that the signal output on line 31 is equivalent to the signal which would be produced by a single receiver located in the far field of the array along a fixed radial from the array. In one embodiment of the invention, such radial is at an angle of 11.5° to the normal to the array.

The monitor signal on line 31 is applied to a synchronous detector 32 which also receives a low level reference signal on line 33 directly derived from the carrier output of transmitter 13. The reference output from transmitter 13 is passed through a 90° phase shifter 34 then applied as one input to detector 32' which receives as a second input the signal on line 31 from monitor antenna 30.

The output of detector 32 is the component of the monitor antenna signal which is in phase with the reference signal from transmitter 13. The output of detector 32' is component of the monitor signal which is in quadrature, i.e. at 90° phase, to the reference signal from transmitter 13. The outputs of detectors 32 and 32' are generally referred to hereinafter, respectively, as the I and Q components, or occasionally as the real and imaginary components, respectively, of the signal from monitor antenna 30.

The output from mixer 32 is passed through a bandpass filter/amplifier 35 and a detector 36 to the input of an analog to digital (A/D) converter 37. The output of mixer 32' is similarly processed through bandpass filter/amplifier 35' and detector 36' to the input of A/D converter 37'. Suitably, filter/amplifiers 35, 35' are designed to pass and amplify signals in the band of 25–75 KHz. Monitor antenna 30, detectors 32, 32', amplifiers 35, 35' detectors 36, 36' and converters 37, 37' correspond to the single detector at $p_R$ of FIG. 2.

Converters 37, 37' are controlled by a programmable logic array (PLA) 38 to provide discrete digitized samples of the outputs of detectors 36, 36' at intervals $t_k$. PLA 38 receives synchronizing signals from the array beam steering unit 39 and enables converters 37, 37' at times during the beam scan cycle determined by formula (14), above. The primary function of beam steering unit 39, of course, is to generate signals controlling the setting of phase shifters 15 of the array, and hence the pointing angle of the array beam.

In the microwave landing system the beam scans in a TO-FRO mode. Starting at the maximum negative scan angle $-\theta_0$ (FIG. 1) the beam scans at the constant rate of 349 rad/sec to the maximum positive scan angle $+\theta_0$, completing the TO scan. After pausing a specified time, the scan direction is reversed and the beam scans from $+\theta_0$ to $-\theta_0$, completing the FRO scan. During consecutive TO and FRO scans, PLA 38 enables converters 37, 37' at times $t_k$ ($t_k$ being measured from the start of a TO or FRO scan) to provide two sets of N data samples, one each for the I and Q components of the output of monitor antenna 30 for each scan. The data samples from converter 37, 37' are placed in buffer storage in a signal processor 40, where they are placed in proper order and condition for transfer to the input of an FFT processor included in signal processor 40.

Figure 4:
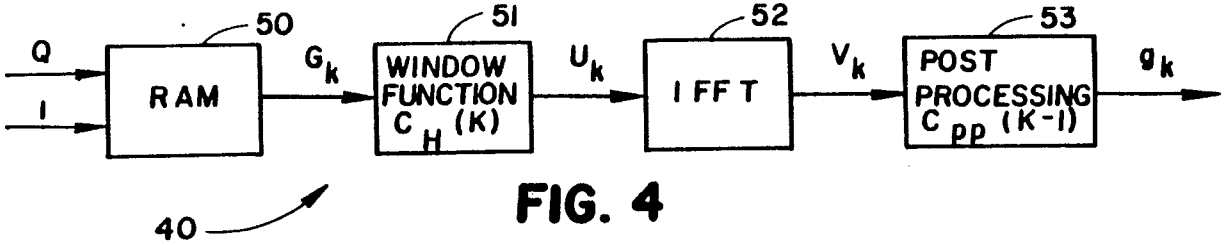
FIG. 4 is a simplified flow diagram of the mathematical processing of the beam samples, the beam samples having been taken at non-uniform intervals of time in accordance with the invention, to produce a reconstructed beam aperture function.

The generalized functions of signal processor 40 are shown in FIG. 4. The antenna aperture function g(kd, t) is complex, hence the in phase (I) and quadrature phase (Q) components of the output of monitor antenna 30 must be processed separately, but identically, up to the point of recovery of amplitude and phase for the sampled data. Thus, the window function and post processing operations described below detector at $p_R$ of FIG. 2.

Converters 37, 37' are controlled by a programmable logic array (PLA) 38 to provide discrete digitized samples of the outputs of detectors 36, 36' at intervals $t_k$. PLA 38 receives synchronizing signals from the array beam steering unit 39 and enables converters 37, 37' at times during the beam scan cycle determined by formula (14), above. The primary function of beam steering unit 39, of course, is to generate signals controlling the setting of phase shifters 15 of the array, and hence the pointing angle of the array beam.

In the microwave landing system the beam scans in a TO-FRO mode. Starting at the maximum negative scan angle $-\theta_0$ (FIG. 1) the beam scans at the constant rate of 349 rad/sec to the maximum positive scan angle $+\theta_0$, completing the TO scan. After pausing a specified time, the scan direction is reversed and the beam scans from $+\theta_0$ to $-\theta_0$, completing the FRO scan. During consecutive TO and FRO scans, PLA 38 enables converters 37, 37' at times $t_k$ ($t_k$ being measured from the start of a TO and FRO scan) to provide two sets of N data samples, one each for the I and Q components of the output of monitor antenna 30 for each scan. The data samples from converter 37, 37' are placed in buffer storage in a signal processor 40, where they are placed in proper order and condition for transfer to the input of an FFT processor included in signal processor 40.

The generalized functions of signal processor 40 are shown in FIG. 4. The antenna aperture function g(kd, t) is complex, hence the in phase (I) and quadrature phase (Q) components of the output of monitor antenna 30 must be processed separately, but identically, up to the point of recovery of amplitude and phase for the sampled data. Thus, the window function and post processing operations described below are performed on one sample set, say the I samples, and the results are stored in RAM in appropriate order, then the same operations are performed on the Q sample set and the results are stored in RAM in proper order, separately from the processed I samples. The FFT algorithm combines the I and Q samples in a prescribed manner, as known to those skilled in the art. Finally the processed I and Q samples are combined to provide the amplitude and phase of the reconstructed aperture function at each of the sample points.

Referring to FIG. 4, the data samples from A/D converters 37, 37' are stored in RAM 50 in two ordered sequences $G_k^I$ (converter 37) and $G_k^Q$ (converter 37') and $k=0 \ldots N-1$.

These sequences are modified by a window function 51 to reduce the data truncation effects caused by utilizing an antenna scan angle which is less than the theoretical maximum scan angle. For example, the element spacing of a particular antenna may be such as to permit a maximum scan angle of ±60°, but such antenna is actually scanned ±40° and the sample data only covers the actual scan.

A choice of known window functions is available and a suitable such function is the Hanning window comprising a sequence of constants $C_H(k)$ given by:

$$C_H(k) = \tfrac{1}{2}\left[1 - \cos\left(\frac{2\pi k}{N-1}\right)\right];\ k = 0 \ldots N-1 \tag{18}$$

These constants are precomputed, stored in a look-up table and are called up as multiplying factors in accordance with the index of the complex sample $G_k$ entering the window function.

After processing by the window function the complex sample sequence is stored as a modified complex sequence $U_k$ where $$U_k = C_H(k)[G_K^R + jG_K^I] \tag{19}$$

The complex $U_k$ data sequence is next passed through an Inverse Fast Fourier Transform (IFFT) 52 to provide the data sequence $V_k$. As is known to those skilled in art, the IFFT involves a multiplicity of "butterfly computations"; for example see the article "What is the Fast Fourier Transform?" IEEE Transactions on Audio and Electroacoustics, pp. 45 ff. v. AU-15, no. 2, June 1967.

The processing of the data sequence $U_k$ by the IFFT to produce the data sequence $V_k$ is expressed mathematically as:

$$V_k = \sum_{n=0}^{N-1} U_k W_N^{nk};\ k = 0,1 \ldots N-1 \tag{20}$$

where $$W_N^{nk} = e^{j2\pi \frac{nk}{N}} \tag{21}$$

The transformed complex data sequence $V_k$ must be referenced to the phase center of the antenna for the reconstructed aperture function h(kd, $P_R$) to correspond to the actual aperture function g (kd, $t_R$). When N, the total number of radiating elements in an array is an odd number, the phase center is the center element of the array. $V_k$ can then be transformed directly into polar coordinates $a_k$, $\phi_k$ without requiring any post IFFT processing.

When N is an even number, the phase reference is mid-way between the two center-most array elements and the $V_R$ sequence output of IFFT 52 must be modified by a series of coefficients $C_{pp}$ so that the reconstructed aperture has the same phase reference as the actual aperture. The $C_{pp}$ coefficients are given by:

$$C_{pp}(k-l) = \frac{1}{N} \cdot \frac{\sin\left[N\pi\left(\frac{k-l}{N}\right)\right]}{\tan\left[\pi\left(\frac{k-l}{N}\right)\right]};\ k = 0 \ldots N-1 \tag{22}$$

$$gk = \sum_{i=1}^{N} C_{pp}(k-l) \cdot V_t \tag{23}$$

The operation of equation (23) is carried out in block 53 for both the real and imaginary parts of $V_k$ to produce the modified sequence:

$$gk = g_k^R + jg_k^I \tag{24}$$

The amplitude $a_k$ and phase $\phi_k$ for each of the antenna radiating elements are readily computed from:

$$a_k = \sqrt{(g_k^R)^2 + (g_k^I)^2} \tag{25}$$

$$\phi_k = \tan^{-1}\left(\frac{g_k^I}{g_k^R}\right) \tag{26}$$

Figure 5:
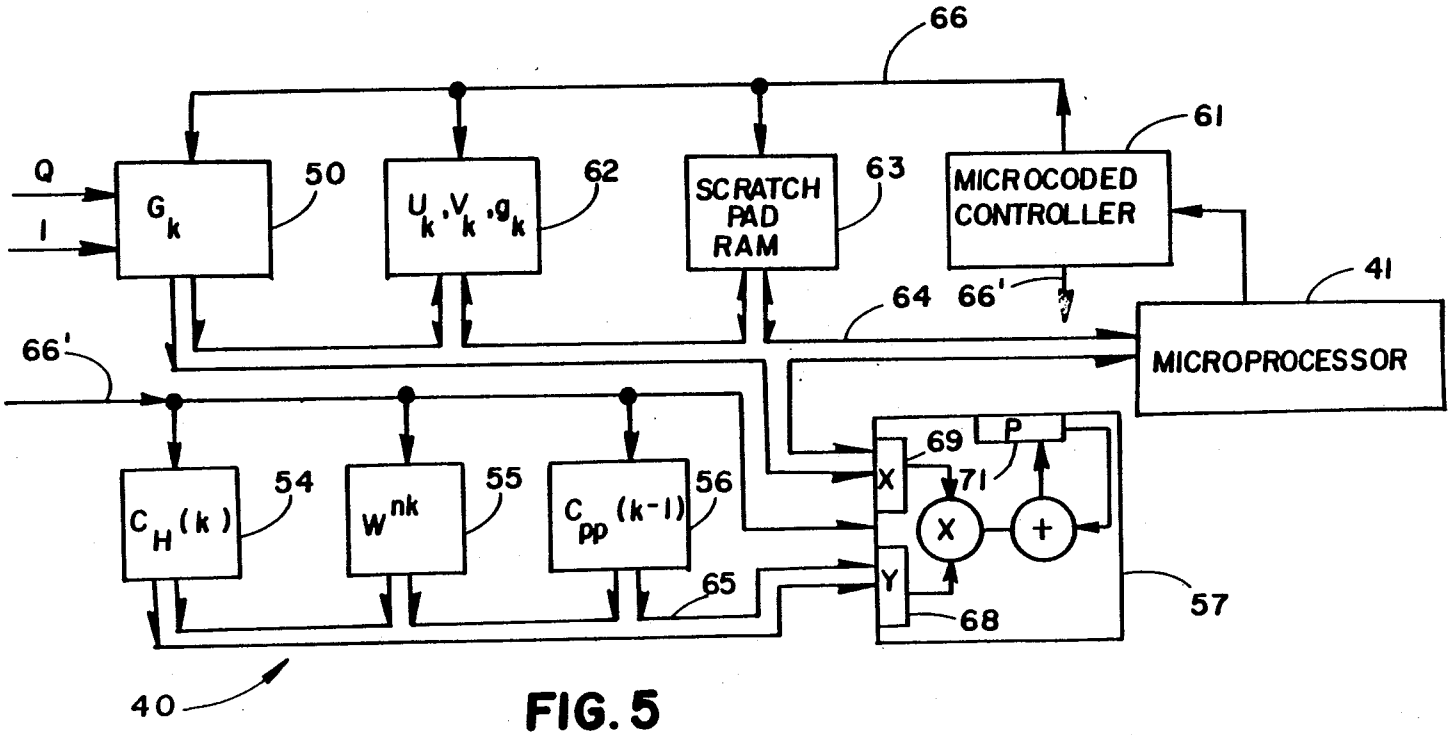
FIG. 5 is a functional block diagram of the signal processor used to perform Fourier transformation of the beam samples taken by a single detector at non-uniform intervals of time to produce a reconstructed aperture function.

Signal processor 40 comprises the elements shown in the block diagram of FIG. 5. The constants $C_H$ (K); $W^{nk}_N$; $C_{pp}$ (k-1) are precomputed and stored in read-only memories (ROM) 54, 55, 56. The arithmetic operations represented by blocks 51, 52 and 53, FIG. 4, are carried out by a multiplier-accumulator (MAC) 57 under the command of a microcoded controller 61. The I and Q data samples from converters 37, 37' are stored in random access memory (RAM) 50. RAM 62 provides storage for the results $U_K$, $V_K$ and $g_K$ of computations 51, 52 and 53. Scratch pad RAM 63 provides buffer storage for transferring data between RAMs 52, 62 and MAC 57. A bi-directional data bus 64 interconnects RAMs 50, 62, 63, MAC 57 and microprocessor 40 for the exchange of data therebetween. Data bus 65 transmits data from a selected one of ROMs 54–56 to the Y input register of MAC 57. Controller 61, under executive control of microprocessor 41, as indicated by control lines 66 and 66', addresses RAM and ROM locations and controls the transfer gates of the data buses 64 and 65. Controller 61 contains a microinstruction set for performing the operations represented by blocks 51–53 of FIG. 4. All of the elements of FIG. 5 are available as standard commercial integrated circuits.

Figure 6:
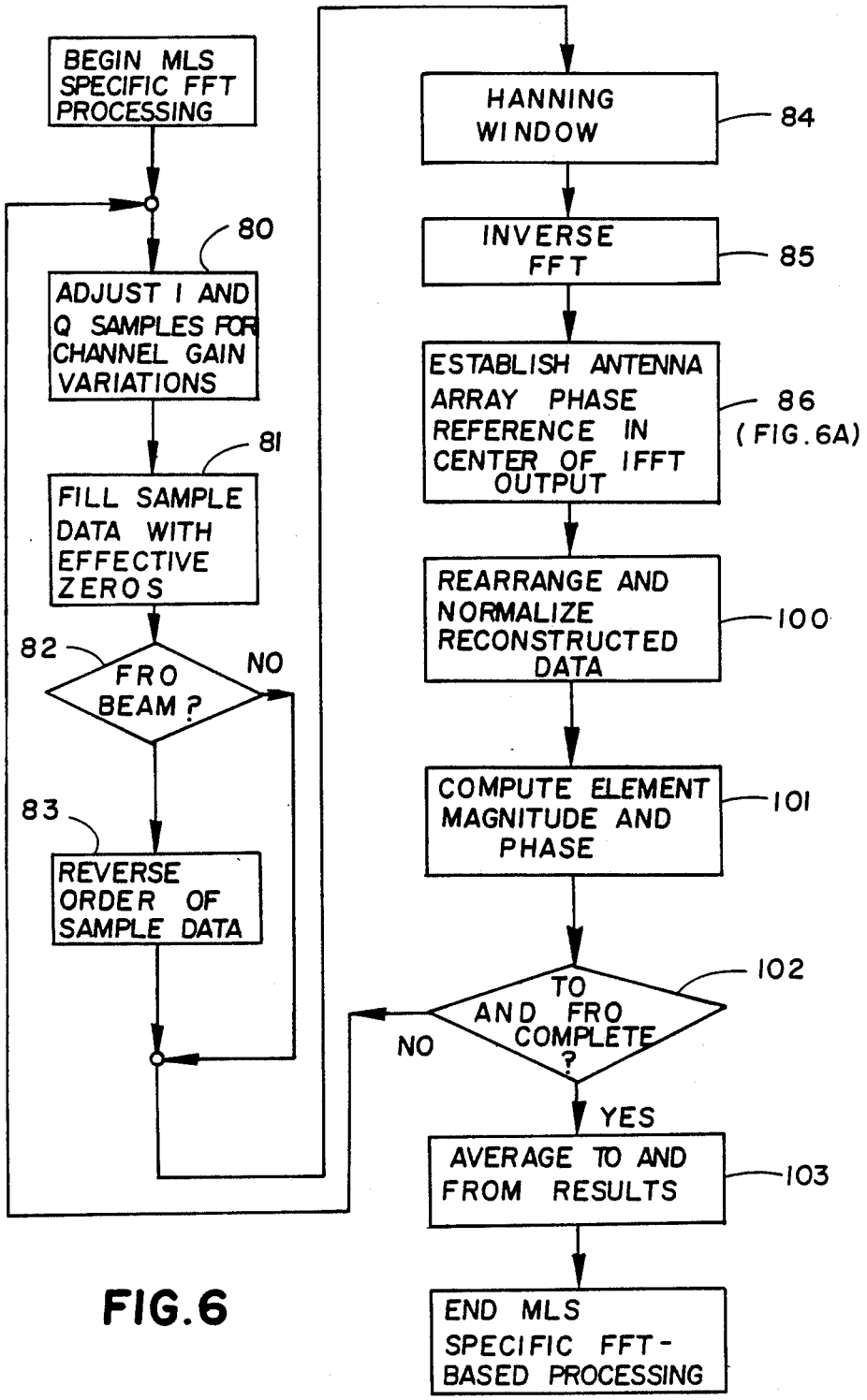
FIGS. 6 and 6A together, is a flow diagram showing in greater detail than FIG. 4 the mathematical processing of the beam samples to produce a reconstructed aperture function.

The executive program for signal processor 40 is illustrated in FIG. 6. Samples taken during an antenna scan, say a TO scan, are stored in RAM 50. At the beginning of the following FRO scan the data stored in RAM 50 is transferred to RAM 63. RAM 50 is then clear to receive samples collected during the FRO scan while data from the previous TO scan is being processed in signal processor 40. The first step 80 of the program is to adjust the numerical vallues of the I and Q samples sequence taken during one scan of the antenna (TO or FRO) for gain variations between the I channel comprising elements 32, 35–37 and the Q channel comprising elements 32', 35–37, FIG. 3.

If the total number N of data samples is such that $\log_2 N$ does not equal an integer, a sufficient number of zero value samples are added at 81, to the sample sequence to cause the logarithm of the increased number of samples to be an integer. Preferably, the zero value samples are added at the beginning and at the end of the data sequence. This is a well-known artifice to facilitate processing of the data by means of an FFT alogrithm. This technique affects all computations of $T_k$, $C_H$, $W_N^{nk}$ and $C_{pp}$.

If the data undergoing processing has been collected during a FRO scan, decision block 82 causes the order of data samples to be reversed at 83 prior to multiplication by the constants $C_H(K)$ at 84. Otherwise, the samples are processed at 84 in the order in which they were collected.

Window function 84 is carried out by a subroutine in controller 61 which transfers the appropriate constant $C_H(K)$ from ROM 54 to the Y input 68 of MAC 57, transfer appropriate sample $G_K$ from RAM 63 to the X input 69 of MAC 57, and stores the XY products from product accumulator 71 of MAC 57 in RAM 62. After the data sequence $G_K$ is processed into the data sequence $U_K$, controller 61 clears RAM 63 and then transfers the sequence $U_K$ into RAM 63 in bit reversed order, following the program given below for Loop #1.

Inverse FFT 85 is performed in two loop operations. Loop #1 directs the transfer from RAM 62 to RAM 63 of the samples comprising the $U_K$ sequence in "bit reversed" order. Loop #2 performs the "butterfly" FFT operation. Basically, Loop #2 breaks the total FFT into two-point FFT stages, cascading those stages to compute the desired output. A detailed explanation of the "bit reversal" and "butterfly" procedures is given in the book "Introduction to Discrete-Time Signal Processing" by S. A. Tretter, 1976, John Wiley, publisher. The program for Loop #1, written in FORTRAN is generalized form is:

```
DO Loop #1
N=2**M
N2=N/2
N1=N-1
J=1
```

-continued

```
DO Loop #1
DO 3 I=1,N1
    IF (I.GE.J)GOTO 1
    T=X(J)
    X(J)=X(I)
    X(I)=T
    K=N2
    IF (K.GE.J)GOTO 3
    J=J-k
    GOTO 2
J=J+k
END
```

After Loop #1 is completed, Loop #2 is performed using the bit reversed $U_K$ samples now stored in RAM 62 and the $W^{nk}$ constants stored in ROM 55 as the X and Y inputs to MAC 57 and storing the $V_K$ outputs of product accumulator 71, according to the following program for Loop #2:

```
DO Loop #2
PI=3.141592653589793
DO 5 L-1, M
  LE=2**L
  LE1=LE/2
  U-(1.0,0.0)
  W-CMPLX(COS(PI/LE1),SIN(PI/LE1))
  DO 5 J=1,LE1
    DO 4 I=J,N,LE
      ID-I+LE1
      T-X(ID)*U
      X(ID)-X(I)-T
      X(I)=X(I)+T
  U=U*W
  RETURN
  END
```

After transformation of the $U_K$ sequence into the $V_K$ sequence, the $V_K$ sequence is post-processed, as shown by block 53, FIG. 4 to establish the phase reference for the antenna array at the mid-point of the $V_K$ sequence. The result is the sequence $g_k$. Post-processing of the sequence $V_K$ is carried out by the sub-routine 86, shown in greater detail in FIG. 6A.

If the antenna array is contructed with an odd number of radiating elements, the phase reference is the center element of the array. Post-processing of the $V_K$ samples is then unnecessary, as $g_k = V_K$. Obviously, in such a case, block 53 can be eliminated from FIG. 4 and ROM 56 can be eliminated from FIG. 5.

If the antenna array is constructed with an even number of radiating elements, the phase reference will lie at a point on the array which is midway between the two centermost elements of the array. In the latter case, post-processing of the $V_k$ samples by subroutine 86 to transform the $V_K$ sequence into the $g_k$ sequence is required so that the amplitude $a_K$ and phase $_K$ at each of the antenna elements can be properly calculated from the $g_k$ data.

Figure 6A:
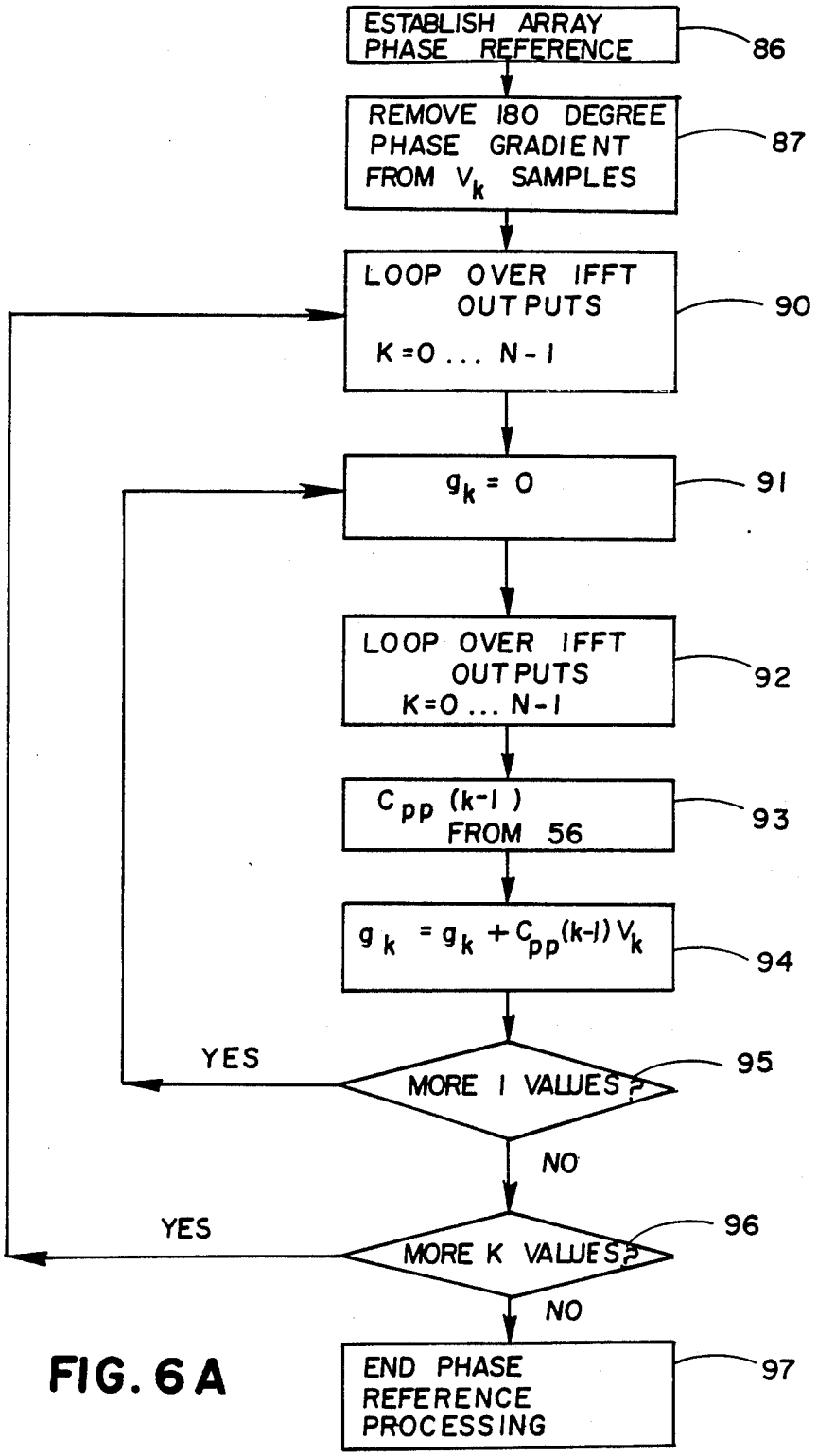

Referring to FIG. 6A, the first step 87 of sub-routine 86 is to remove any 180 degree phase gradients which may be present in the samples of the $V_K$ sequence, i.e., only the absolute values of the $V_K$ samples are processed. Steps 90–94 functionally illustrate the instructions given by controller 61 to MAC 57 in summing $C_{pp}(k-1)V_K$ over $1=0,N-1$. As each $g_k$ sample is input from ROM 62 to register 69 of MAC 57, block 93 calls the appropriate $C_{pp}(k-1)$ constant from ROM 56 for input to register 68 and the product is added to the sum contained in accumulator 71 until all $1=0,N-1$, values of $C_{pp}(k-1)$ for the kth sample have been processed. Then the next in order k sample of $V_K$ is similarly processed. After all N samples of the sequence $V_K$ have been so processed, transformation of the $V_K$ sequence into the $g_k$ sequence has been accomplished and the program of FIG. 6 is continued.

Referring to FIG. 6, instruction 100 directs the transfer to RAM 63 of the gk samples stored in RAM 62 at the end of the sub-routine of FIG. 6A. There the gk samples are rearranged in numerical order and normalized. Then instruction 101 directs the computation of amplitude $a_K$ and phase $\phi_K$ for each antenna radiating element, applying formulas (25) and (26). Upon computation of $a_K$ and $\phi_K$ for the TO antenna scan, decision block 102 returns to block 80 to perform the program of FIG. 6 for the $g_k$ samples taken during the FRO scan. When $a_K$ and $\phi_K$ have been computed, instruction 103 averages $a_k$ and $\phi_k$ computed from the TO and FRO scan data and exits the program.

The averaged $a_k$ and $\phi_k$ data are compared by microprocessor 41 with corresponding stored design or calibration $a_k$ and $\phi_k$ values for each antenna radiating element. Any antenna element showing more than a tolerable difference is identified in a print-out from printer 42 for for remedial action.

The system of the invention not only provides on-line monitoring of an operational MLS, but it is also useful for initial calibration of the MLS antenna array. In that case $a_k$ and $\phi_k$ values computed from scan data are compared with corresponding design values. Any radiating element showing an intolerable variance between the design and computed values is identified for either physical or electronic treatment. That is, it may be necessary either to rework or to replace certain of the phase shifters 15 or couplers 16 to correct anomalies in $a_k$ or it may be possible to correct anomalies in $\phi_k$ by adding a fixed compensating factor to the $\phi_K$ steering command from beam steering unit 34 for the faulty element. If such compensating factors are added to $\phi_K$, the values of $\phi_k$ as adjusted, i.e., the calibration values, as used as comparison standards during monitoring operation, rather than design values.

APPENDIX
LIST OF EQUATIONS $$t_k = \frac{\sin^{-1}\left[\frac{\lambda}{2d}\left(1-\frac{2k}{N}\right)\right]}{\dot{\theta}_s} - t_o;\ k = 0,1\ldots N-1 \tag{1}$$

$$\phi_k = \frac{2\pi d}{\lambda}\left(k-\frac{N+1}{2}\right)\sin\theta_o - \sin\theta_{tR} \tag{2}$$

$$g(kd,t) = a(kd)\epsilon^{jp(t)kd} \tag{3}$$

$$p(t) = \frac{2\pi}{\lambda}\sin\theta\ (t) \tag{3a}$$

$$G(p,t) = \sum_{k=0}^{N-1} g(kd,t)\epsilon^{-jpkd} \tag{4}$$

$$p\ kd = \frac{2\pi}{\lambda}\ kd\sin\theta \tag{4a}$$

$$G(p,t) = \sum_{k=0}^{N-1} a(kd)\epsilon^{-j(p-p(t))kd} \tag{5}$$

-continued
APPENDIX
LIST OF EQUATIONS $$G(p_i,t) = \sum_{k=0}^{N-1} a(kd)\epsilon^{-j(pi-p(t))kd} \tag{5}$$

$$p_i = \frac{2\pi}{\lambda}\sin\theta_i \tag{6a}$$

$$f(md,t_R) = \frac{1}{N}\sum_{i=0}^{N-1} G(p_i,t_R)\epsilon^{+jpimd} \tag{7}$$

$$\begin{aligned} f(md) &= \frac{1}{N}\sum_{L=0}^{N-1}\left[\sum_{k=0}^{N-1} a(kd)\epsilon^{-j[pi-p(tR)]kd}\right]\epsilon^{jpimd} \\ &= \sum_{k=0}^{N-1} a(kd)\epsilon^{+jp(tR)kd}\left[\frac{1}{N}\sum_{L=0}^{N-1}\epsilon^{-jpi[kd-md]}\right] \end{aligned} \tag{8}$$

$$\frac{1}{N}\sum_{L=0}^{N-1}\epsilon^{-jpi[kd-md]} = \delta_{km} \tag{9}$$

$$\delta_{km} = \begin{cases} 0, k \neq m \\ 1, k = m \end{cases} \tag{9a}$$

$$f(md,t_R) = \sum_{k=0}^{N-1} a(kd)\epsilon^{jp(tR)kd}\,\delta_{km} \tag{10}$$

$$f(kd,t) = a(kd)\epsilon^{jp(t)kd} = g(kd,t) \tag{11}$$

$$G(p_R,t_i) = \sum_{k=0}^{N-1} a(kd)\epsilon^{-j[pi-pR]kd} \tag{12}$$

$$p_R = \frac{2\pi}{\lambda}\sin\theta_R \tag{12a}$$

$$p_i = \frac{2\pi}{\lambda}\sin\theta_i \tag{12b}$$

$$\sin\theta_R = \text{constant} \tag{12c}$$

$$\sin\theta_i = -\frac{\lambda}{2d}\left[1-\frac{2k}{N}\right];\ i = 0,1,2\ldots N-1 \tag{12d}$$

$$\theta_i = -\sin^{-1}\left(\frac{\lambda}{2d}\right) + 349.06t_i \tag{13}$$

$$t_i = \frac{\sin^{-1}\left(\frac{\lambda}{2d}\left[1-\frac{2i}{N}\right]\right)}{349.06} - t_o \tag{14}$$

$$h(md,p_R) = \sum_{L=0}^{N-1} G(p_R,t_i)\epsilon^{+jpimd} \tag{15}$$

$$h(md,p_R) = \sum_{k=0}^{N-1} a(kd)\epsilon^{jpRkd}\left[\frac{1}{N}\sum_{j=0}^{N-1}\epsilon^{-jpi[kd-md]}\right] \tag{16}$$

$$h(md,p_R) = \sum_{k=0}^{N-1} a(kd)\epsilon^{jpRkd}\,\delta_{km} \tag{17}$$

$$C_H(k) = \tfrac{1}{2}\left[1-\cos\left(\frac{2\pi k}{N-1}\right)\right];\ k = 0\ldots N-1 \tag{18}$$

$$U_k = C_H(k)[G_K{}^R + jG_K{}^I] \tag{19}$$

$$V_k = \sum_{n=0}^{N-1} U_k W_N^{nk};\ k = 0,1\ldots N-1 \tag{20}$$

$$W^{nk} = \epsilon^{-j2\pi\frac{nk}{N}} \tag{21}$$

-continued

APPENDIX

LIST OF EQUATIONS $$C_{pp}(k-l) = \frac{1}{N} \cdot \frac{\sin\left[N\pi\left(\frac{k-l}{N}\right)\right]}{\tan\left[\pi\left(\frac{k-l}{N}\right)\right]}; k = 0 \ldots N-1 \quad (22)$$

$$g_k = \sum_{i=1}^{N} C_{pp}(k-l) \cdot V_l \quad (23)$$

$$g_k = g_k^R + jg_k^I \quad (24)$$

$$a_k = \sqrt{(g_k^R)^2 + (g_k^I)^2} \quad (25)$$

$$\phi_k = \tan^{-1}\left(\frac{g_k^I}{g_k^R}\right) \quad (26)$$

The invention claimed is:

1. The method of monitoring the performance of a scanning phased array antenna to identify faults in said antenna, said antenna having a plurality of radiating elements and plurality of phase shifters associated with said elements to control the direction of a beam of energy transmitted by said radiating elements, said antenna scanning between the maximum angles of $+\theta_o$ and $-\theta_o$, $\theta$ being the angle between the axis of said beam and the normal to the axis of the array of said antenna, comprising:

collecting, from a single detector of signals transmitted by said antenna, at equal increments of arcsin $\theta$, a plurality of signal samples;

analyzing said collected samples by means of a Fourier transform to provide a sequence of data indicating the amplitude and phase of the signal radiated by each of said antenna radiating elements when the beam of said antenna was directed toward said detector; and comparing the data of said sequence with known values of the amplitude and phase of the signal radiated by each of the radiating elements of said antenna when said antenna is perfectly functioning and the beam thereof is directed toward said detector.

2. A method as claimed in claim 1, wherein:

said antenna radiates energy having a wavelength $\lambda$;

said plurality of radiating elements of said antenna comprises a total number N, each of said elements being separated by equal distances d;

said beam is a scanning beam which scans at a constant rate equal to $\dot{\theta}_s$; and said collected samples comprise a sequence of samples taken at times $t_k$, where $t_k$ is given by:

$$t_k = \frac{\sin^{-1}\left[\frac{\lambda}{2d}\left(1 - \frac{2k}{N}\right)\right]}{\theta_s} - t_o; k = 0, 1 \ldots N-1$$

where $k=0,1, \ldots N-1$, and $t_o$=time at the start of scan.

3. A method as claimed in claim 1, wherein each of said collected samples is a complex number comprising an in-phase component I and a quadrature component Q and, wherein said step of analyzing said collected samples includes the step of:

multiplying each of said I and Q components by a window function constant prior to said step of analyzing said collected samples by means of a Fourier transform; and said window function constant having the property of modifying said collected samples to compensate for the loss of data due to said step of collecting signal samples between the maximum scan angles of $-\theta_o$ and $+\theta_o$ when $\theta_o$ is less than arcsine $\lambda/2d$, $\lambda$ being the wavelength of the energy radiated by said antenna and d being the distance separating each of said radiating elements of antenna.

4. A method as claimed in claim 3, wherein said window function constant is a series of constant numbers $C_H(k)$ and each number of said series is given by the formula:

$$C_H(k) = \tfrac{1}{2}\left[1 - \cos\left(\frac{2\pi k}{N-1}\right)\right]; k = 0 \ldots N-1$$

where k is the order in which respective ones of said samples are collected, and $k=0, 1, \ldots N-1$, N being the total number of said radiating elements of said antenna.

5. A method as claimed in claim 3, wherein said step of analyzing said collected samples further includes the step of:

adding, after said step of multiplying said collected samples by said window function constants and prior to analyzing said samples by means of a Fourier transform, a further number of zero-value samples to said collected samples to provide a data sequence $U_M$ until the total number of said collected samples and said added zero-value samples in said sequence $U_K$ is equal to a quantity comprising an integer power of the number 2.

6. A method as claimed in claim 5, wherein said step of analyzing said collected samples by means including a Fourier transform produces a second data sequency $V_K$ and, wherein said step of analyzing comprises the process expressed mathematically as:

$$V_k = \sum_{n=0}^{N-1} U_k W_N^{nk}; k = 0, 1 \ldots N-1$$

where $$W^{nk} = \epsilon^{-j2\pi \frac{nk}{N}}$$

7. A method as claimed in claim 6, wherein the total number of radiating elements of said antenna is an even number, with said radiating elements being linearly disposed and equally spaced apart along the length of said antenna and, wherein the phases of the signals radiated by said radiating elements vary linearly along the length of said antenna, wherein said step of analyzing said collected samples includes the steps of:

multiplying each of the samples of said second data sequence $V_k$ by individual post-processing constants $C_{pp}$ to produce a third data sequence $g_k$;

calculating from said third data sequence $g_k$ the amplitude and phase of the signal radiated by each of said radiating elements; and said constants $C_{pp}$ having the property of modifying said samples of said data sequence $V_k$ so that said phases calculated from said data sequence $g_k$ are with reference to the phase at a point midway along the length of said antenna.

8. A method as claimed in claim 7, wherein said individual constants $C_{pp}$ are given by the formula:

$$C_{pp}(k-l) = \frac{1}{N} \cdot \frac{\sin\left[N\pi\left(\frac{k-l}{N}\right)\right]}{\tan\left[\pi\left(\frac{k-l}{N}\right)\right]}; k = 0 \ldots N-1$$

k being the order of each of said samples in said data sequence $V_k$ and k−0, 1, . . . N−1; 1 being the series 1=1, 2, . . . N.

9. A method as claimed in claim 6, wherein the total number of radiating elements of said antenna is an odd number, with said radiating elements being linearly disposed and equally spaced along the length of said antenna, each said radiating element being identified by a number k according to the order of location of said element along the length of sad antenna;

said second data sequence $V_k$ being complex with each sample k thereof being related to a corresponding k one of said radiating elements;

said sequence $V_k$ having a real component R and an imaginary component I;

and wherein said step of analyzing said collected samples to provide the amplitude and phase of the signal radiated by each of said radiating elements includes the step of calculating the amplitude $a_k$ of the signal radiated by each said radiating element k from the formula:

$$a_k = \sqrt{(g_k^R)^2 + (g_k^I)^2}$$

and the step of calculating the phase $\phi_k$ of the signal radiated by each said radiating element k from the formula:

$$\phi_k = \tan^{-1}\left(\frac{g_k^I}{g_k^R}\right).$$

10. The method of calibrating a scanning phased array antenna to adjust the performance thereof to conform to design spcifications therefor, said antenna having a plurality of radiating elements and a plurality of phase shifters associated with said elements to control the direction of a beam of energy transmitted by said radiating elements, said beam being a scanning beam which scans between the maximum angles of $-\theta_o$ and $+\theta_o$, $\theta$ being the angle between the axis of said beam and the normal to the axis of the array of said antenna, comprising:

collecting, at equal increments of arcsin $\theta$, from a single detector of signals transmitted by said antenna, a plurality of signal samples;

analyzing said collected samples, by means including a Fourier transform, to provide a sequence of data indicating the amplitude and phase of the signal radiated by each of said antenna radiating elements when said beam of said antenna was directed toward said detector;

comparing the amplitude of the signal radiated by each of said radiating elements as given by said sequence of data with design values of amplitude for the signal intended to be radiated by each of the radiating elements when the beam thereof is directed toward said detector; and adjusting the amplitude of the signal radiated by any one of said radiating elements of said antenna to conform to the design value of the amplitude of the signal intended to be radiated by that said one radiating element when the amplitude of the signal radiated by that said one radiating element as given by said sequence of data differs from said design value therefor.

11. The method of calibrating a phased array antenna as claimed in claim 10 with the additional step of:

comparing the phase of the signal radiated by each of said radiating elements as given by said sequence of data with design values of the phase for the signal intended to be radiated by each of the radiating elements when the beam thereof is directed toward said detector; and adjusting the phase of the signal radiated by any one of said radiating elements of said antenna to conform to the design value of the phase of the signal intended to be radiated by that said one radiating element when the phase of that said one radiating element as given by said sequence of data differs from said design value therefor.

12. A method of calibrating a phased array antenna as claimed in claim 11 wherein:

said antenna radiates energy having a wavelength $\lambda$;

said plurality of radiating elements of said antenna comprises a total number N, each of said elements being separated by equal distances d;

said beam is a scanning beam which scans at a constant rate equal to $\dot{\theta}_s$; and said collected samples comprise a sequence of samples taken at times $t_k$, where $t_k$ is given by:

$$t_k = \frac{\sin^{-1}\left[\frac{\lambda}{2d}\left(1 - \frac{2k}{N}\right)\right]}{\theta_s} - t_o; k = 0, 1 \ldots N-1$$

where k=0, 1, . . . N−1, and $t_o$=time at the start of scan.

13. The method of calibrating a phased array antenna as claimed in claim 12, wherein said antenna includes a beam steering unit and said phase shifters are adjustable under the control of command signals issued by said beam steering unit to each of said phase shifters and wherein the step of adjusting the phase of the signal radiated by any one of said radiating elements to conform to the design value of the phase intended to be radiated by that one radiating element includes:

modifying the command signal issued by said beam steering unit to that said one radiating element to include a compensating factor, said compensating factor being such as to alter the phase of the signal radiated by that said one of the radiating elements to conform to said design value therefor.

14. A system for monitoring the performance of a phased array antenna to identify faults in said antenna, said antenna having a plurality of radiating elements and a plurality of phase shifters associated with said elements, a transmitter and feed means for distributing output from said transmitter to said phase shifters and said radiating elements, said phase shifters and said radiating elements cooperating to shape the output received by each from said transmitter into a beam of energy and to control the direction in which said beam is pointed, comprising:

means for receiving the signal radiated by said antenna to provide a received signal;

means for synchronously detecting said received signal to provide a first component thereof which is in phase with said output of said transmitter and a second component thereof which is in quadrature phase with said output of said transmitter;

means for amplitude detecting said first component to provide a first analog signal which is proportional to the amplitude of said first component;

means for amplitude detecting said second component to provide a second analog signal which is proportional to the amplitude of said second component;

a first analog to digital (A/D) converter for converting said first analog signal to a first digital signal;

a second analog to digital (A/D) converter for converting said second analog signal to a second digital signal;

means for controlling said first and second A/D converters whereby said first and second A/D converters provide discrete digital samples of said first and second analog signals with said digital samples being separated from one another by non-uniform intervals of time, said first and second digital samples forming a sequence of data which is in the form of a complex number; and means for mathematically processing said sequence of data to provide the value of the amplitude and phase of the signal radiated by each of said radiating elements of said antenna when said beam of said antenna is pointed in the direction of said means for receiving.

15. A system as claimed in claim 14, wherein said means for mathematically processing includes:

means for performing a Fourier transform on said sequence of data to provide a second sequence of data from which said amplitude and phase of said signal radiated by each of said radiating elements is computed.

16. A system as claimed in claim 15, wherein the beam transmitted by said antenna is a scanning beam and said beam scans between the maximum angles $-\theta_o$ and $+\theta_o$, $\theta$ being the angle between the axis of said beam and the normal to the axis of the array of said antenna, and wherein said means for controlling said first and second A/D converters enables said converters to provide said samples at successive equal increments of arcsine $\phi$.

17. A system as claimed in claim 16, wherein said radiating elements are disposed in a linear array with said radiating elements being spaced apart by equal distances d and wherein said means for controlling said first and second A/D converters enables said converters to provide said samples at times $t_k$ given by:

$$t_k = \frac{\sin^{-1}\left[\frac{\lambda}{2d}\left(1 - \frac{2k}{N}\right)\right]}{\theta_s} - t_o;\ k = 0, 1 \ldots N - 1$$

where $\lambda$ is the wavelength of the energy radiated by said antenna;

d is the distance between each of said radiating elements;

N is the total number of said radiating elements;

$t_o$ is the time at the start of scan; and k=0, 1, . . . N=1.

18. A system as claimed in claim 17, wherein said means for receiving the signal radiated by said antenna includes a monitor antenna comprising:

a slotted waveguide, said waveguide extending the length of said linear array and being positioned adjacent thereto.

* * * * *